US005765841A

United States Patent [19]

Johnson et al.

[11] Patent Number: 5,765,841

[45] Date of Patent: Jun. 16, 1998

[54] IN-LINE SKATE WITH FULL ACCESS FRAME

[75] Inventors: Robert Keith Johnson, Blaine; Lloyd Gerhardt Keleny, Champlin; Timothy Joseph Wiener, Minnetonka; Randy Carl Peterson, Plymouth, all of Minn.; Robert Duane Harr, Arvada; Michael David Racosky, Nederland, both of Colo.

[73] Assignee: Rollerblade, Inc., Minnetonka, Minn.

[21] Appl. No.: 629,718

[22] Filed: Apr. 9, 1996

[51] Int. Cl.[6] ..... A63C 17/04

[52] U.S. Cl. ..... 280/11.22; 280/11.23; 280/11.27

[58] Field of Search ..... 280/11.22, 11.23, 280/11.27, 11.19, 7.13, 7.14, 11.3

[56] References Cited

U.S. PATENT DOCUMENTS

| | | | |
|---|---|---|---|
| 3,292,940 | 12/1966 | Weitzner | 280/7.13 |
| 4,666,168 | 5/1987 | Hamill et al. | 280/11.2 |
| 4,666,169 | 5/1987 | Hamill et al. | 280/11.23 |
| 5,199,726 | 4/1993 | Willet | 280/11.27 |
| 5,277,437 | 1/1994 | Moats | 280/11.23 |
| 5,401,038 | 3/1995 | Peck et al. | 280/11.2 |

FOREIGN PATENT DOCUMENTS

| | | |
|---|---|---|
| WO 95/03101 | 2/1995 | WIPO . |
| WO 95/03861 | 2/1995 | WIPO . |

OTHER PUBLICATIONS

Advertisement: Volcanix, "Stop Playing Around With Yesterday's Technology" (undated).

Advertisement: Lotuskate, "While Pursuing Speed And Excitement Lotuskate Provides You With Safety And Comfort", Inline, April 1996.

*Primary Examiner*—Brian L. Johnson

*Assistant Examiner*—Bridget Avery

*Attorney, Agent, or Firm*—Merchant, Gould, Smith, Edell, Welter & Schmidt, P.A.

[57] ABSTRACT

An in-line skate with full access frame is provided which includes a skate boot with a sole portion, a two-piece frame secured to the boot sole and a plurality of wheels. The frame includes a first frame portion and a second frame portion cooperating to form a wheel channel when the second frame portion is in a first position adjacent to the first frame portion. The skate wheels are disposed for rotation within the wheel channel. Preferably, the first frame portion is securely connected to the boot sole with the second frame portion movably connected to the first frame portion. The second frame portion is movable from the first position adjacent to the first frame portion to a second position away from the first frame portion to allow access to the wheels. The second frame portion preferably includes at least one connector member sized to be received within a corresponding support cavity or slot in the first frame portion or the boot sole when the second frame portion is in the first position. The second frame portion may be pivotally connected to the first frame portion or boot sole so that the second frame portion is movable from the first position to the second position. Preferably, the frame includes a plurality of wheel shafts securely attached to the first frame portion.

14 Claims, 6 Drawing Sheets

IN-LINE SKATE WITH FULL ACCESS FRAME

BACKGROUND OF THE INVENTION

1. Field of the Invention

This invention relates generally to the field of in-line skates in which a boot is secured to a frame housing a plurality of wheels.

2. Description of the Art

In the field of in-line skates, it is known to provide a boot having a rigid outer shell and sole which is attached to a frame. The frame houses and supports a plurality of wheels. Typically, the frame is formed of a rigid material and is secured to the sole of the boot. The frame consists of a one-piece or two-piece member having opposing sidewalls which extend down from the top of the frame to form a channel for receiving the wheels. The top portion of the frame is typically bolted to the sole of the boot to rigidly secure the frame for use. The wheels are disposed for rotation within the wheel channel of the frame and are secured between the opposing sidewalls through some type of fastening mechanism.

Typically, various combinations of mounting hardware, such as bolts and shafts, are utilized to secure the wheels for rotation between the opposing sidewalls of the frame. For example, it is known to provide a shaft in the form a bolt such that the wheels are disposed in the frame channel adjacent corresponding apertures in the sidewalls of the frame so that the bolt is inserted in one aperture, through the center of the wheel, and extends out the opposite aperture to be secured with a nut.

It is also known to provide a wheel with an internal shaft disposed in the center of the wheel such that the outer portion of the wheel rotates about the inner shaft. This shaft includes for example an inner bore with internal threads designed to receive a screw in both ends of the bore. The wheel is then positioned in the channel of the frame so the inner bore of the wheel is aligned with the opposing apertures in the sidewalls of the frame. A screw is then inserted through the aperture in each sidewall for engagement with the ends of the inner bore to secure the wheel for use. Typically, the head of the screw is formed with a recessed hex shape so that a special hex-shaped tool is required to tighten or loosen the screw.

These typical frame-wheel assemblies in which the wheels are removable from the frame provide numerous advantages for the skater. First, with the wheels generally made from a hard, elastomeric material, the wheels are subject to considerable wear from use on hard surfaces such as concrete. As disclosed in U.S. Pat. No. 5,048,848, eccentric axle aperture plugs may be utilized to orientate several of the skate wheels at a lower level than the other skate wheels. For example, it is often desirable to position the center pair of wheels at a slightly lower level than the front and rear wheels to produce a rocking action for enhanced steering and maneuvering. This positioning of the wheels within the frame wheel channel may result in uneven wear of the wheels during use. Therefore, it is desirable for a skater to periodically service the wheels by rotating the positions of the wheels within the wheel channel. This allows for more even wear of all the wheels so the skater does not have to replace any one wheel as much. The skater may also desire to use different wheels for different purposes. For example, by changing the type of wheel, the skater can vary the type of ride a skate will give. Additionally, the wheels need to be replaced periodically after they are sufficiently worn.

These prior one-piece or two-piece frames are designed so that the opposing sidewalls of the frame remain fixed and immovable relative to each other during servicing of the wheels. This results in numerous problems for the skater concerning the removability and exchangability of the wheels. First, the non-removable sidewall frame construction having the wheels secured inside the wheel channel of the frame with mounting hardware requires excessive time and labor to exchange the positions of the wheels for servicing. To rotate the position of the wheels, the skater must first remove the wheels from the frame. This requires some type of tool to loosen the mounting hardware so that the wheel is disconnected from the frame. For the in-line skate described above having two screws secured to an inner bore of the wheel shaft, a skater is required to use two tools so that one screw is held in place while the other is loosened and vice versa. The skater then has to keep track of the two screws for each wheel while removing the other wheels. After the screws are removed, the skater must then remove the wheel from the frame by pulling the wheel out from the bottom of the frame channel. The skater also needs to remember which wheel came from which location on the frame in order to reposition the wheels in the correct location on the frame.

The non-removable frame construction also makes it difficult to reassemble the wheels on the frame. First, the skater must insert the wheel into the wheel channel and attempt to align the center of the wheel with the corresponding apertures in the sidewalls of the frame. While holding the wheel in this position, the skater must insert the screw or bolt through the frame aperture for engagement with the inner bore of the wheel shaft. After securing the screw or bolt in one side of the wheel bore, the skater must then turn the skate over and insert a screw or bolt through the other frame aperture to engage the opposite end of the wheel bore to secure the wheel for use.

Similarly, with other mounting hardware such as a nut and bolt, the bolt shaft must be completely removed from the frame so the wheel can be removed from the wheel channel. For reassembly, the wheel must be held in alignment with the sidewall apertures while the bolt is extended through the wheel to be secured with the nut. Since each skate generally has three or four wheels, these wheel servicing problems are encountered repeatedly for each wheel.

What is needed is a wheel-frame assembly for an in-line skate which provides for quick removal and replacement of the wheels by the skater while minimizing the number of fastening parts that need to be removed by the skater. Further, a wheel-frame assembly is needed which allows for quick, easy removal of a portion of the frame to provide access to the wheels so that a skater can easily reposition all of the wheels simultaneously.

SUMMARY OF THE INVENTION

The present invention provides an in-line skate having a frame which allows for full access to the wheels for quick, efficient removal or repositioning of the wheels for servicing. Further, the full-access frame preferably provides easy access to the wheels without sacrificing the structural integrity of the frame during use.

According to one aspect of the present invention, there is provided an in-line skate having a skate boot with a sole portion, a two piece frame attached to the sole of the boot and a plurality of wheels. The frame includes a first frame portion and a second frame portion cooperating to form a wheel channel when the second frame portion is in a first position adjacent the first frame portion. The skate wheels are disposed for rotation within the wheel channel and the second frame portion is movable from the first position adjacent to the first frame portion to a second position away from the first frame portion to allow access to the wheels. In this way, a skater may easily and efficiently service the wheels.

According to one embodiment of the invention, the first frame portion is securely connected to the sole portion of the boot with the second frame portion removably connected to either the first frame portion or the sole portion of the boot to facilitate even distribution of force throughout the frame during use. The second frame portion preferably includes at least one connector member sized to be received within a corresponding cavity or slot in the first frame portion or sole of the boot when the second frame portion is in the first position adjacent to the first frame portion.

Pursuant to one embodiment of the present invention, the second frame portion is pivotally connected to the first frame portion. In this way, the second frame portion is pivotal from the first position to the second position to allow access to the wheels. The second frame portion is preferably removable from connection with the first frame member when pivoted to the second position to provide unrestricted access to the wheels disposed in the wheel channel.

According to another aspect of the present invention, the frame preferably includes a plurality of wheel shafts securely attached to the first frame portion and sized to receive the wheels for rotation. The wheel shafts preferably extend through corresponding apertures in the second frame portion when the second frame portion is in the first position adjacent to the first frame portion. In this position, an appropriate fastener is then secured to the end of the wheel shafts to rigidly connect the first frame portion to the second frame portion with the wheels disposed on the wheel shafts for use. Preferably, the wheel shaft includes an eccentric plug portion designed to be received in a corresponding aperture in the first frame portion to permit the wheel shaft to occupy two distinct axle positions relative to the frame.

The above-described features and advantages, along with various other advantages and features of novelty, are pointed out with particularity in the claims of the present application which form a part hereof. However, for a better understanding of the invention, its advantages, and objects obtained by its use, reference should be made to the drawings which form a further part of the present application and to the accompanying descriptive manner in which there is illustrated and described preferred embodiments of the invention.

DETAILED DESCRIPTION OF THE INVENTION

Figure 1:
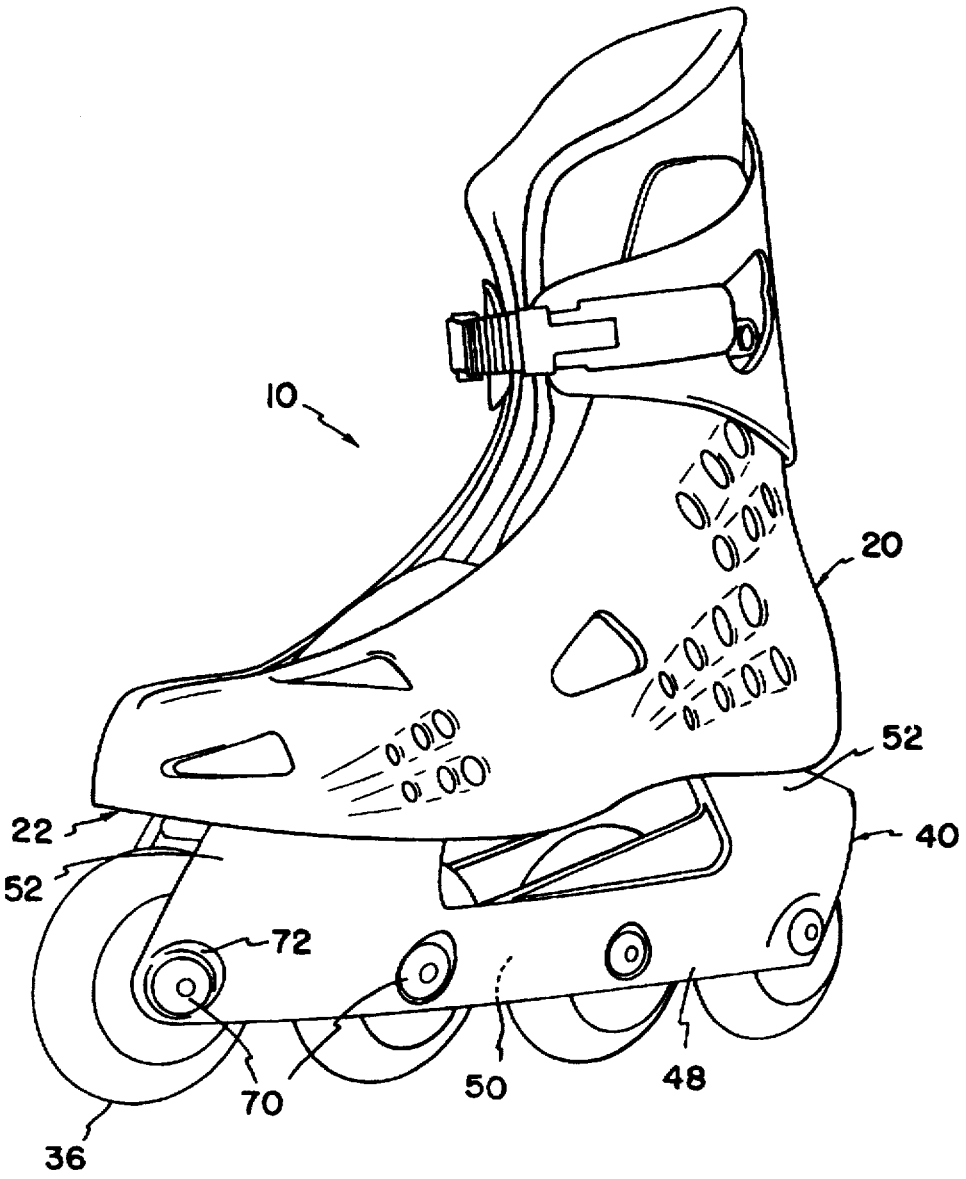
FIG. 1 is a perspective view of an in-line skate with full access frame according to the principles of the present invention.

Referring now to the drawings in which similar elements are numbered identically throughout, a description of preferred embodiments is provided. In FIG. 1, a perspective view of an in-line skate with a full access frame according to the principles of the present invention is generally illustrated at 10. A typical in-line skate includes a skate boot 20 preferably composed of a rigid material, having a sole portion 22 at the bottom of the boot which is secured to a frame 40 and wheels 36 assembly.

Figure 2:
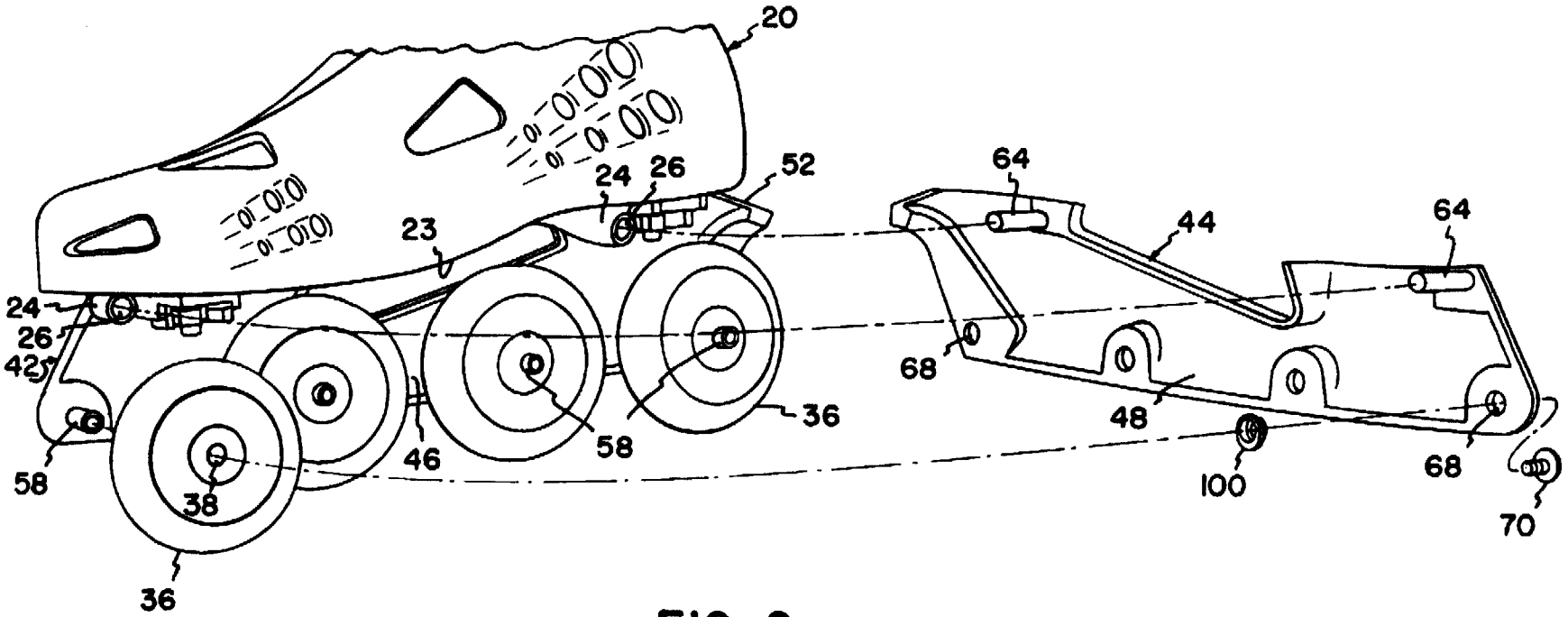
FIG. 2 is an exploded view of an in-line skate with full access frame shown in FIG. 1.
Figure 6:
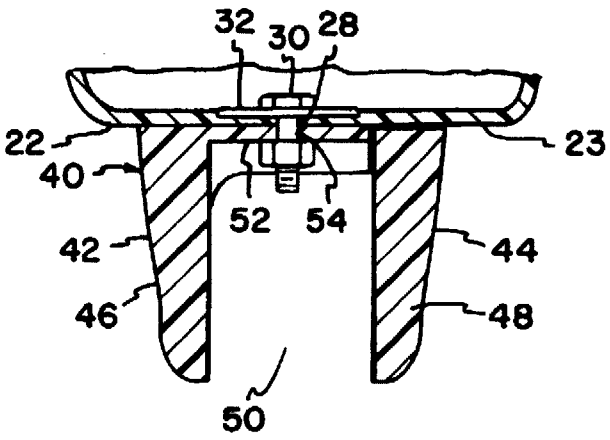
FIG. 6 is a view taken along line 6—6 in FIG. 4.

Referring now to FIG. 2, the frame 40 includes a first frame portion 42 and a second frame portion 44 having sidewalls or rails 46, 48, respectively, cooperating to form a wheel channel 50 (FIG. 6). A plurality of wheels 36 are disposed for rotation within the wheel channel 50 of the frame 40 (FIG. 1). It should be noted that for illustration purposes, the in-line skate has been configured with four wheels. However, the present invention is equally applicable to an in-line skate having more or less than four wheels.

Typically, the wheels 36 include an inner bore 38 which is sized to fit on a shaft 58 which extends between the sidewalls 46, 48 of the frame 40. In one embodiment, the wheel shafts 58 extend transversely from the sidewall 46 of the first frame portion 42 into the wheel channel 50 to support the wheels 36 and further extend to a position adjacent apertures 68 in the second frame portion 44. A fastening screw 70 is then inserted through the apertures 68 and secured to the end of each of the wheel shafts 58 to retain the wheels in position between the sidewalls 46, 48 of the frame 40 for use. This also serves to rigidly connect the first and second frame portions 42, 44 during use. It will be appreciated that other similar fastening mechanisms may be utilized to connect the two frame portions together.

The first frame portion 42 is securably fastened to the sole 22 of the boot 20. Preferably, the first frame portion 42 is formed having two upper support sections 52, each including an aperture 54 (FIG. 6), which are disposed against the underside 23 of the sole 22 so that the support section aperture 54 is in alignment with a corresponding aperture 28 in the sole 22. A fastener 30, such as a bolt, is inserted through the apertures and secured with a nut to rigidly connect the first frame portion 42 to the underside 23 of the boot sole 22. A plate 32 may also be used in conjunction with the fastener 30 to assist in distributing forces from the head of the bolt. It should be noted that a variety of other similar methods may be utilized to rigidly secure the first frame portion 42 to the underside 23 of the boot sole 22 as is known in the art. Alternatively, the first frame portion 42 may be formed integrally with the boot sole 22.

Figure 7:
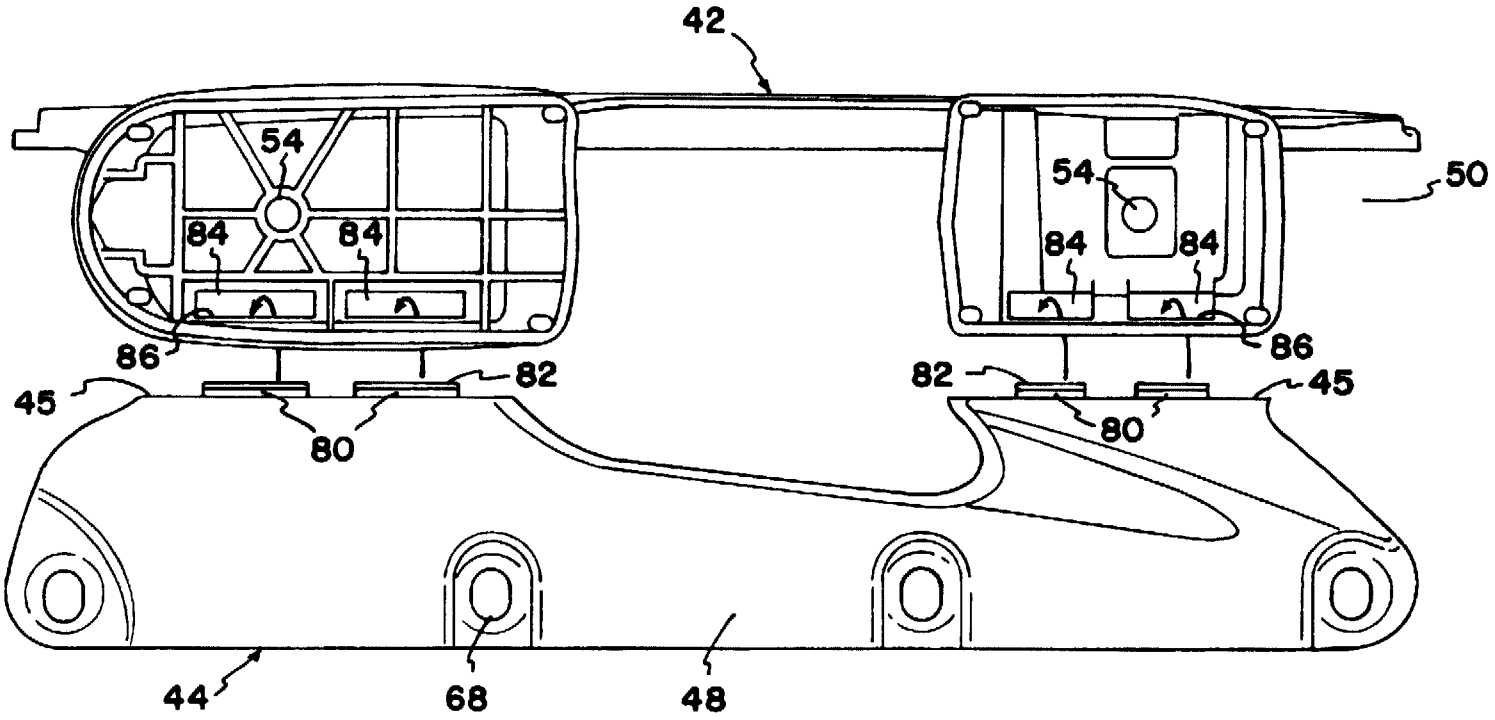
FIG. 7 is a top plan view of an alternative embodiment of a full access frame according to the principles of the present invention with the second frame portion removed from the first frame portion.

The second frame portion 44 is preferably connected to either the first frame portion 42 or the boot sole 22 so it is movable from a first position (FIG. 1) adjacent to the first frame portion 42 and wheel channel 50 to a second position (FIG. 2) away from the first frame portion 42 to allow simultaneous access to all of the wheels 36 disposed within the wheel channel 50. In one embodiment, the second frame portion 44 is pivotally connected to the first frame portion 42 to permit the second frame portion 44 to be rotated out of connection with the first frame portion 42. As shown in FIGS. 7, 9, the top edge 45 of the second frame portion 44 includes a plurality of hinge-like members 80 disposed within corresponding slots 84 in the first frame portion 42 to releasably connect the frame portions 42, 44 together. The second frame portion 44 is then pivotal from a position in connection with the first frame portion 42 (see FIG. 8) in which the wheels 36 are secured for use to a second position out of connection with the first frame portion 42 (see FIG. 7) to allow full access to the wheels 36 for repositioning or replacement.

As shown in FIG. 9, the hinge-like members 80 of the second frame portion 44 pivot about the lip or edge 86 of the slots 84 in the first frame portion 42. As the second frame portion 44 is pivoted away from the first frame portion 42, the hinge-like members 80 disengage the edge of the slot lip 86 and the second frame portion 44 may be removed entirely from connection with the first frame portion 42 (FIG. 7).

With the frame in the normal position for use, the finger or hook portion 82 of the hinge-like members 80 rests against the lip 86 of the slots 84 in the first frame portion 42. In this position, the second frame portion 44 is orientated in a substantially vertical position to form one-half of the wheel channel 50 (see FIG. 9). The wheel mounting mechanism described above is then utilized to securely connect the first and second frame portions together. In this way, the second frame portion 44 is rigidly maintained in this position and is prevented from lateral or vertical movement during use by the skater.

Figure 8:
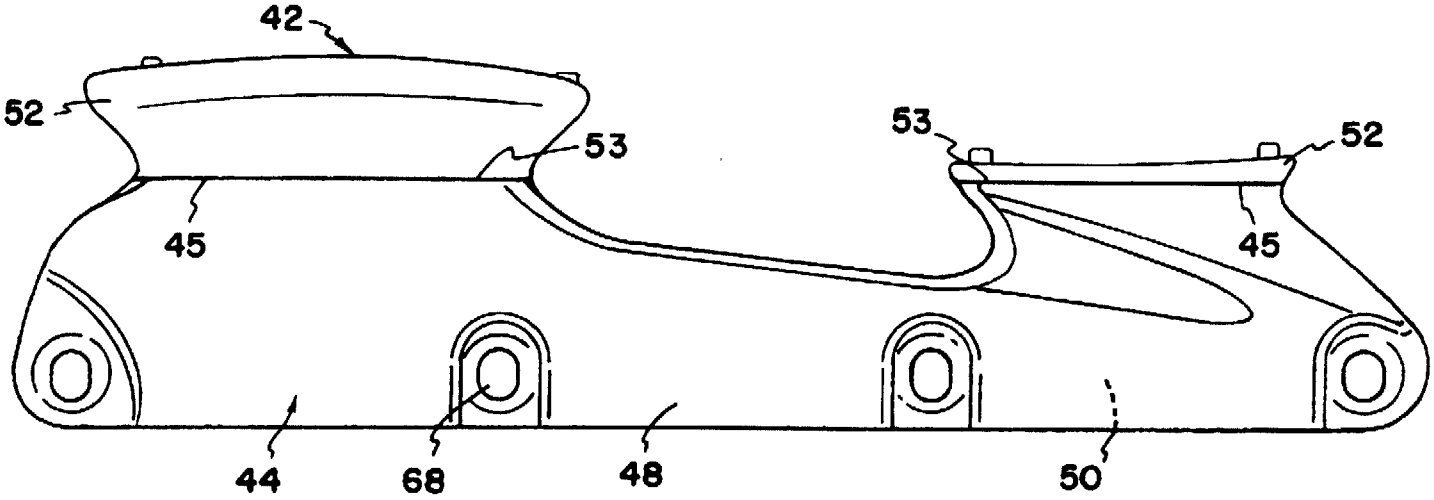
FIG. 8 is a side view of the full access frame shown in FIG. 7 with the second frame portion connected to the first frame portion.
Figure 9:
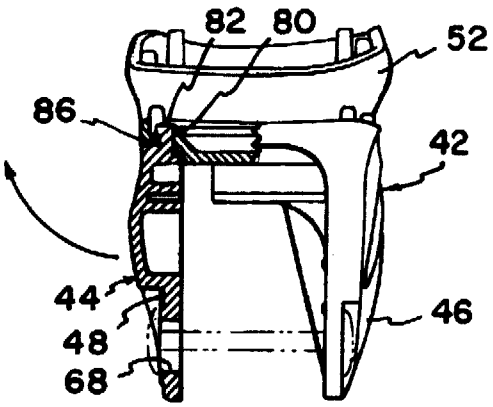
FIG. 9 is a front partial sectional view of the full access frame shown in FIG. 8.

As shown in FIG. 8, the upper edge 45 of the second frame portion 44 may be designed for disposition against the bottom 53 of the upper support sections 52 of the first frame member 42 when the frame portions are connected together. This permits efficient transfer of force between the first and second frame portions during use by a skater. With both frame portions preferably constructed of the same material, this hinge-like connection allows for smooth attachment of the frame portions so that the forces generated from the skate wheels impacting the skating surface are evenly distributed throughout the entire frame. In this way, the two-piece removable frame of the present invention accomplishes the structural support functions of prior non-removable one-piece and two-piece frames.

As discussed above, the second frame portion 44 is preferably removable from connection with the first frame portion 42 to allow access to the wheels 36 disposed in the frame channel 50. To remove the second frame portion 44, the fastening screws 70 are removed from attachment with the wheel shafts 58. The second frame portion 44 is now able to be pivoted to the second position so that the hinge-like members 80 disengage from the lip 86 of the slots 84 in the first frame portion 42 to completely disconnect the second frame portion 44 from the rest of the skate (FIG. 7).

It will be appreciated that by removing the second frame portion 44 from connection with the first frame portion 42, all of the wheels 36 simultaneously are easily accessible for servicing. For example, if a skater wishes to rotate the position of the wheels 36, the skater simply removes the fastening screws 70, pivots and lifts off the second frame portion 44, and now all of the wheels are accessible for easy servicing. This full access frame of the present invention saves time and is more efficient than prior non-removable frames especially since the wheel shafts 58 do not need to be removed when servicing the wheels. Rather, the skater simply removes one wheel off its shaft and then removes another wheel off another shaft to exchange the two. In contrast, prior non-removable frames require each wheel shaft to be removed from the frame to permit each wheel to be withdrawn from the wheel channel and then subsequently require each wheel to be individually inserted back into the wheel channel for alignment and securement.

Figure 3:
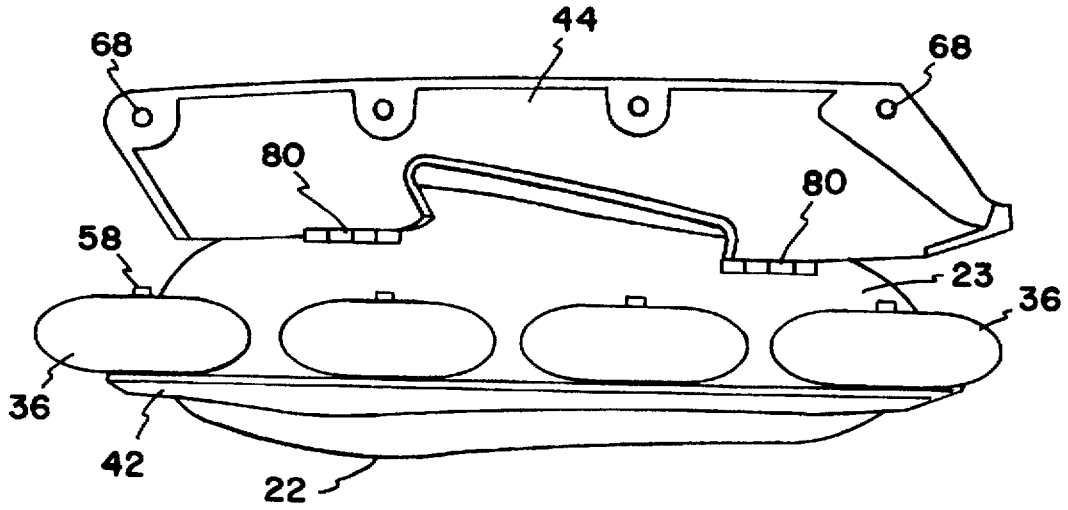
FIG. 3 is an alternative embodiment of an in-line skate with full access frame.
Figure 4:
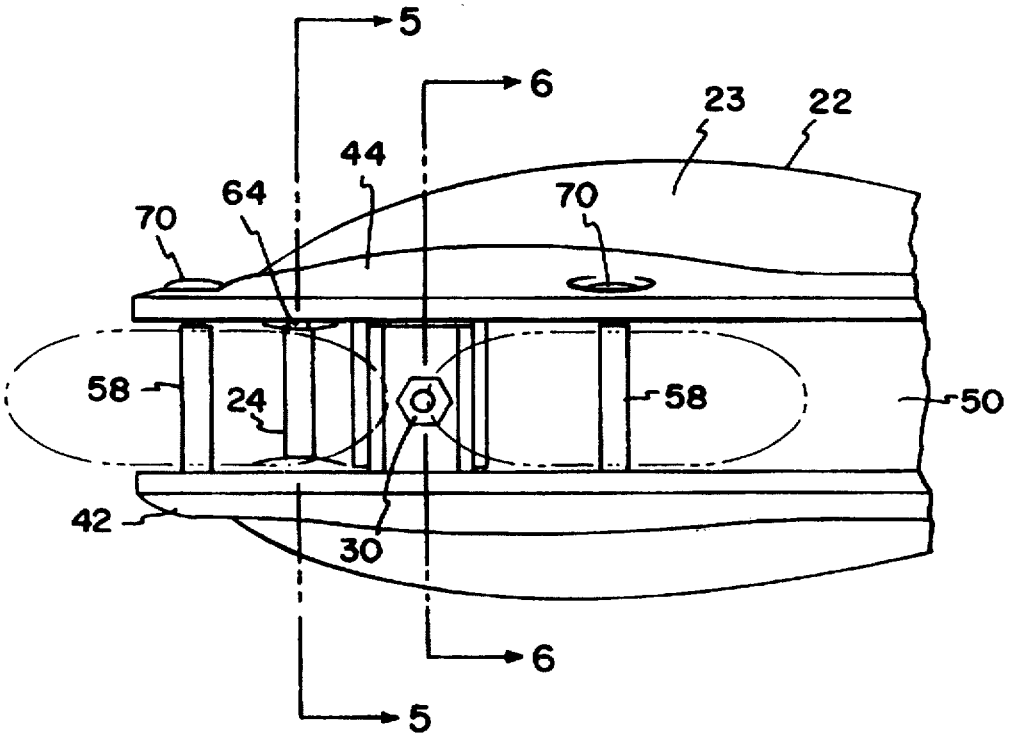
FIG. 4 is a bottom view of a partial section of an in-line skate with full access frame.

It is important to note that while this particular embodiment is illustrated with hinge-like members and slots, a variety of other pivot mechanisms may be utilized to pivotally connect the frame portions in accordance with the principles of the present invention. For example, the pivot mechanism may include a non-removable hinge as shown in FIG. 3. In this way, the second frame portion 44 is pivoted out of position adjacent the wheel channel 50 but is not completely detachable from the first frame portion 42 or boot sole 23. Additionally, the number of hinge-like members 80 used may be varied without substantially affecting the performance of the skate.

Figure 5:
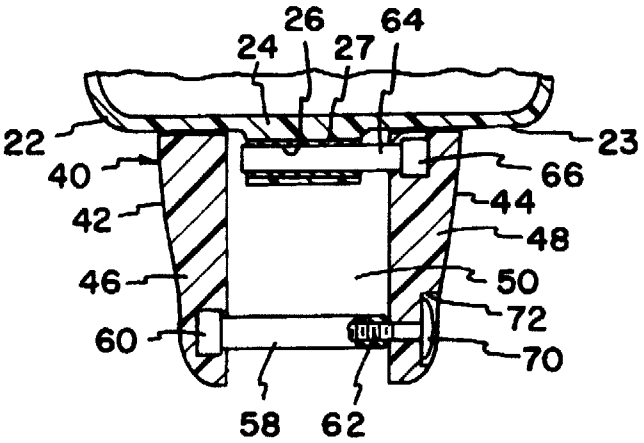
FIG. 5 is a view taken along line 5—5 in FIG. 4.

In another embodiment (FIG. 2), the second frame portion 44 includes connector members or rods 64 which are integrally formed with the second frame portion 44 and extend generally transversely from the sidewall 48 of the second frame portion 44. As shown in FIG. 5, the connector rods 64 preferably include an enlarged head portion 66 which is firmly embedded in the sidewall 48 of the second frame portion 44 for added strength and support. The connector rods 64 are positioned in the upper part of the second frame portion 44 so as to extend adjacent the underside 23 of the boot sole 22.

In this embodiment (see FIG. 2), the boot sole 22 includes two support members 24 extending below the underside 23 of the sole 22. These support members 24 each include a cavity 26 sized to receive the connector rod 64 of the second frame portion 44. It should be noted that while the particular embodiment is illustrated with two connector rods 64 and corresponding sole support cavities 26, the number and location of connector rods utilized may vary as long as the second frame portion 44 is connected in some way to the first frame portion 42 or boot sole 22 during use by a skater.

Furthermore, it is appreciated that numerous alternatives to this embodiment may be utilized in accordance with the principles of the present invention. For example, the connector members or rods of the second frame portion 44 may be formed as other geometric configurations such as a rectangular dovetail or square shape and still engage a corresponding cavity or slot in the first frame portion 42 (or boot sole) for connection of the frame portions. Similarly, the connector member of the second frame portion 44 may engage the corresponding cavity or slot of the first frame portion 42 from a horizontal or vertical direction as long as the second frame portion 44 can be securely retained in the first position adjacent the first frame portion 44 and wheel channel 50 during use by a skater. Alternatively, the first frame portion 42 or boot sole 22 may include the connector member for engagement with a corresponding cavity or slot located on the movable second frame portion 44. All such alternative configurations are within the scope of the invention.

According to another aspect of the present invention, the frame 40 may be constructed with the wheel shafts 58 rigidly secured to the first frame portion 42. According to one embodiment, each wheel shaft 58 includes a head 60 which is permanently disposed within the sidewall 46 of the first frame portion 42 (FIG. 5). The shaft 58 extends transversely from the sidewall 46 to support the skate wheel 36. The end of each shaft 58 preferably includes an inner bore 62 having internal threads sized to receive a fastening screw 70. As shown in FIG. 5, the fastening screw 70 extends through the aperture 68 in the second frame member 44 to engage the inner bore 62 of the wheel shaft 58 to securely connect the two frame portions. The head of the fastening screw 70 is preferably countersunk in a recessed portion 72 of the second frame portion 44 adjacent to the aperture 68 for alignment purposes and to reduce resistance, as illustrated in FIG. 5.

Figure 10:
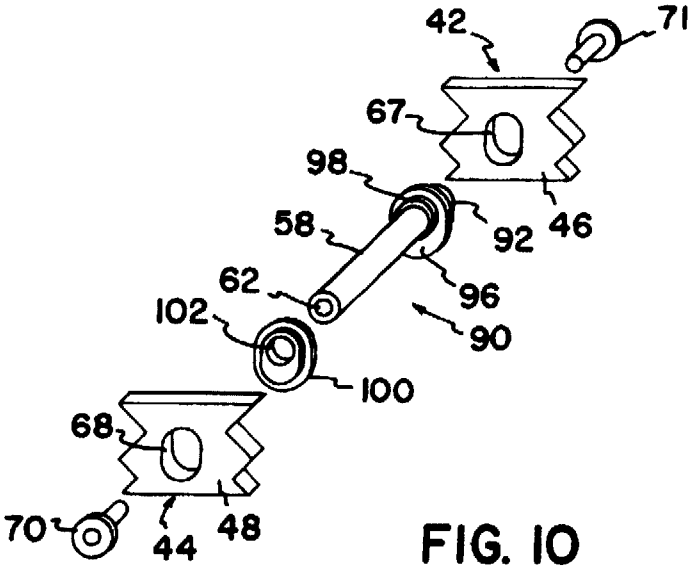
FIG. 10 is an exploded view of a wheel shaft assembly according to the principles of the present invention.

Referring to FIG. 10, another embodiment comprises a semi-permanent wheel shaft assembly 90 which includes an eccentric plug portion 92 at one end designed to be received in a corresponding aperture 67 in the first frame portion 42. The eccentric plug portion 92 has an internal threaded bore (not shown) and includes a collar 96 which bears against the inner surface of the adjacent side wall 46 (FIG. 10). It is appreciated that the collar 96 maintains proper spacing between the opposing sidewalls 46, 48 and improves the lateral rigidity of the frame during use. The eccentric plug portion 92 is inserted in the corresponding aperture 67 in the first frame member 42 and a fastening screw 71 is inserted in the internal bore of the plug portion 92 to rigidly secure the wheel shaft assembly 90 to the first frame portion 42. An annular rim 98 is preferably located adjacent the collar 96 and wheel shaft 58 to provide a washer-like mechanism which contacts the adjacent wheel bearing and thereby assures necessary clearance between the wheel and side wall 46 of the first frame portion 42.

It is contemplated that this wheel shaft assembly is utilized in conjunction with a corresponding eccentric aperture plug 100 as described in U.S. Pat. No. 5,048,848. Referring to FIG. 10, this aperture plug 100 is inserted in a corresponding aperture 68 in the second frame portion 44 and includes a bore 102 for receiving the end of the wheel shaft 58. A fastening screw 70 is then secured to the end of the wheel shaft 58 to connect the frame portions 42, 44 together.

It will be appreciated that the construction of a fixed wheel shaft 58 extending from the first frame portion 42 for connection to the second frame portion 44 provides for quick, easy replacement or repositioning of the wheels 36. For a typical in-line skate having four wheels, a skater only needs to remove the four fastening screws 70 from connection with the wheel shafts 58 and then remove the second frame portion 44 from the first frame portion 42 to expose the wheels (FIGS. 2, 7). With the wheels 36 disposed on the wheel shafts 58, the skater may easily access the desired wheels for servicing.

It is important to note that the full access frame assembly of the present invention requires the removal of fewer parts when servicing the wheels then prior non-removable frames. As described above, for a typical in-line skate having four wheels, only the four fastening screws 70 need to be removed to service all the wheels. For prior non-removable frames, the wheel shafts must be removed from the wheel channel as well as any mounting hardware so that the wheel can be withdrawn from the wheel channel. By having fewer parts for removal, the present invention reduces the possibility of a skater misplacing parts during servicing of the wheels. Also, since the wheel shafts 58 are rigidly secured to the first frame portion 42, only one tool is required to loosen the fastening screws 70 to remove the wheels 36. This saves time and is easier than prior skates which often require several tools to remove a wheel from the frame.

Additionally, it should be appreciated that the fixed wheel shafts 58 allow the skater to retain the wheels 36 on the shafts 58 until replacement. This minimizes the possibility of the skater forgetting which wheel came from which location during servicing of the wheels. Further, the fixed wheel shafts 58 eliminate the need for the skater to align the wheels 36 with the second frame portion apertures 68 during reassembly. Rather, to reassemble the skate for use, the wheels 36 are inserted on the wheel shafts 58 and the second frame portion 44 is then moved back to the first position adjacent the first frame portion 42. As the second frame portion 44 is returned to the first position, the wheel shafts 58 are positioned adjacent to the apertures 68 and any axle aperture plugs 100 in the second frame portion 44. Without requiring any aligning by the skater, the fastening screws 70 are simply inserted into the apertures 68 and any axle aperture plugs 100 in the second frame portion 44 for engagement with the inner bore 62 of the shafts 58 to rigidly connect the first and second frame portions with the wheels disposed on the wheel shafts for use.

It is appreciated that the wheel shaft assembly 90 as shown in FIG. 10 provides for a wheel shaft 58 rigidly secured to the first frame portion 42 during normal use and servicing of the wheels. However, this wheel shaft assembly 90 does provide the added flexibility of permitting dual positioning of the wheel shafts 58. A skater need only remove the fastening screw 71 secured to the inner bore of the plug portion 92 of the wheel shaft assembly 90. The plug portion 92 is then withdrawn and manually rotated for reinsertion in the aperture 67 of the first frame portion 42 to orientate the wheel shaft at a different level. Similarly, the aperture plug 100 disposed in the aperture 68 of the second frame portion 44 is withdrawn and rotated to correspond to the new position of the wheel shaft 58. It is further appreciated that the plug portion 92 of the wheel shaft assembly 90 and the aperture plug 100 are shaped so they cannot rotate between the two positions or orientations without first being manually withdrawn from the apertures 67, 68 and manually rotated by the skater. While the plug portion 92 and plug 100 are disclosed as oblong in shape, it is noted that various other geometric configurations may be utilized as long as they resist unwanted rotation.

It is to be understood that even though numerous characteristics and advantages of various embodiments of the present invention have been set forth in the foregoing description, together with the details of the structure and function of various embodiments of the invention, this disclosure is illustrative only and changes may be made in the detail, especially in matters of shape, size, and arrangement of parts with the principles of the present invention, to the full extent indicated by the broad general meaning of the terms in which the appended claims are expressed.

Other modifications of the invention will be apparent to those skilled in the art in view of the foregoing descriptions. These descriptions are intended to provide specific examples of embodiments which clearly disclose the prevent invention. Accordingly, the invention is not limited to the described embodiments or to use of specific elements, dimensions, materials or configurations contained therein. All alternative modifications and variations of the present invention which fall within the spirit and broad scope of the appended claims are covered.

What is claimed is:

1. An in-line roller skate comprising:

a skate boot having a sole portion;

a frame secured to said sole portion of the boot having a first frame portion and a second frame portion cooperating to form a wheel channel;

a plurality of wheels disposed for rotation within said wheel channel between said first frame portion and said second frame portion;

a plurality of wheel shafts and a first set of fasteners for removeably mounting said plurality of wheels within said wheel channel, wherein the wheel shafts are securely attached to the first frame portion and extend within the wheel channel between the first and second frame portions to receive the wheels thereon for rotation and said second frame portion includes a plurality of apertures such that an end of each wheel shaft opposite the first frame portion is positioned adjacent said apertures in the second frame portion with the first set of fasteners releaseably connected to the end of the wheel shafts adjacent the apertures in the second frame portion to securely connect the first and second portions together, wherein upon disconnection of the fasteners from the wheel shafts, said second frame portion is movable, from a first position adjacent to said first frame portion and wheel channel to a second position away from said first frame portion and wheel channel while the first frame portion remains securely connected to the sole portion of the boot to allow access to said wheels within the wheel channel.

2. A skate according to claim 1 wherein said sole portion of the boot includes at least one support member defining a cavity and said second frame portion includes at least one corresponding connector member sized to be received within said cavity of the support member when said second frame portion is in said first position in connection to said first frame portion.

3. A skate according to claim 1 wherein the plurality of wheel shafts are securely disposed in and integral with said first frame portion.

4. A skate according to claim 1 further comprising a second set of fasteners and wherein the wheel shafts are integral with the wheels and include an inner bore and the first frame member includes a plurality of apertures disposed adjacent the wheels and wheel shafts such that the second set of fasteners are disposed within the apertures in the first frame portion for engagement with the inner bore of the wheel shafts to securely attach the wheel shafts to the first frame member.

5. A skate according to claim 3 wherein said plurality of wheel shafts include an inner bore at an end opposite said first frame portion and said first set of fasteners are in the form of screws which are disposed in the apertures in the second frame portion for engagement with the inner bore of the shafts to connect said second frame portion to said first frame portion.

6. An in-line roller skate comprising:

a skate boot having a sole portion;

a frame secured to said sole portion of the boot having a first frame portion and a second frame portion cooperating to form a wheel channel when the second frame portion is in a first position adjacent to said first frame portion, said first frame portion securely connected to said boot sole portion and said second frame portion movably connected to said first frame portion;

a plurality of wheels disposed for rotation within said wheel channel;

said second frame portion movable from the first position adjacent said first frame portion to a second position away from said first frame portion to allow access to said wheels while the first frame portion remains securely connected to the sole portion of the boot.

7. A skate according to claim 6 wherein said second frame portion is pivotally connected to the first frame portion and is pivotal between said first position and said second position such that said wheels are accessible when the second frame portion is pivoted to the second position.

8. A skate according to claim 5 wherein said first frame portion includes a connecting portion defining a slot and said second frame portion includes at least one corresponding connector member sized to be received within said slot of the connecting portion when said second frame portion is in said first position in connection to said first frame portion.

9. A skate according to claim 5 wherein said frame includes a plurality of shafts securely attached to said first frame portion and extending from said first frame portion into said wheel channel to receive said plurality of wheels thereon for rotation.

10. A skate according to claim 7 wherein the second frame portion is removable from connection with said first frame portion when the second frame portion is pivoted to the second position.

11. A frame for connection to an in-line skate having a boot with a sole portion and a plurality of wheels, said frame comprising:

a first frame portion and a second frame portion cooperating to form a wheel channel when the second frame portion is in a first position adjacent to said first frame portion, said first frame portion securely connected to said boot sole portion and said second frame portion movably connected to said first frame portion, the second frame portion having a plurality of apertures;

a plurality of wheel shafts securely attached to said first frame portion and extending within the wheel channel between the first and second frame portions to receive the plurality of wheels thereon for rotation;

a plurality of fasteners for removably fastening said plurality of wheel shafts to the second frame portion wherein the fasteners are disposed within the apertures in the second frame portion for engagement with an end of the wheel shafts opposite the first frame portion to connect the second frame portion to the first frame portion;

wherein upon disconnection of the fasteners from the wheel shafts, the second frame portion is movable from the first position adjacent to said first frame portion to a second position away from said first frame portion to allow access to the plurality of wheels disposed within the wheel channel while the first frame portion remains securely connected to the sole portion of the boot.

12. A frame according to claim 11 wherein said first frame portion includes a plurality of apertures and said plurality of wheel shafts each includes a plug portion formed at one end and sized for disposition within a corresponding aperture in the first frame portion and further including fasteners for securing said plug portion of the wheel shafts within said apertures such that said wheel shafts extend into said wheel channel.

13. A frame according to claim 11 wherein said plurality of wheel shafts are integrally formed with said first frame portion such that said wheel shafts extend into said wheel channel.

14. A frame according to claim 12 wherein said plug portions of the wheels shafts and the corresponding apertures in the first frame portion are shaped such the wheel shafts are prevented from rotation when the plug portions are securely disposed within the apertures in the first frame portion.

* * * * *